US005299325A

United States Patent [19]

Kamber et al.

[11] Patent Number: 5,299,325

[45] Date of Patent: Apr. 5, 1994

[54] BELT WITH POUCH AND SLITS FOR RETAINING A SCARF

[75] Inventors: Christine L. Kamber, 5409 Braninburg Ct., Carmichael, Calif. 95608; Leuenda A. O'Neill, Sacramento, Calif.

[73] Assignee: Christine Louise Kamber, Carmichael, Calif.

[21] Appl. No.: 770,094

[22] Filed: Oct. 1, 1991

[51] Int. Cl.[5] ..... A41F 9/00

[52] U.S. Cl. ..... 2/338; D2/629; D2/636

[58] Field of Search ..... 2/338, 336, 144, 155, 2/308, 311, 312, 314, 315, 317, 318, 319; D2/624, 627, 629, 636, 156

[56] References Cited

U.S. PATENT DOCUMENTS

| | | | |
|---|---|---|---|
| D. 32,863 | 6/1900 | Orayeh . | |
| D. 33,621 | 11/1900 | Wasserstrom . | |
| D. 95,549 | 5/1935 | Sachs . | |
| 594,201 | 11/1897 | Frothingham . | |
| 644,557 | 2/1900 | Koch | 2/338 |
| 648,267 | 4/1900 | Koch | 2/338 |
| 2,082,346 | 6/1937 | Levenson | 2/338 |
| 2,084,720 | 6/1937 | Alexandre | 2/237 |
| 2,427,119 | 9/1947 | Bensel | 2/338 |
| 3,848,270 | 11/1974 | Rand | 2/311 |
| 4,525,879 | 7/1985 | Kalomeris | 2/338 |
| 5,054,433 | 10/1991 | Pfleger | 2/338 |
| 5,060,316 | 10/1991 | Jepsen | 2/338 |

FOREIGN PATENT DOCUMENTS

| | | | |
|---|---|---|---|
| 3323104 | 1/1985 | Fed. Rep. of Germany | 2/338 |
| 387492 | 7/1908 | France | 2/144 |
| 15806 | 1/1898 | Switzerland | 2/338 |
| 215666 | 5/1924 | United Kingdom | 2/144 |

*Primary Examiner*—Clifford D. Crowder
*Assistant Examiner*—Larry D. Worrell, Jr.
*Attorney, Agent, or Firm*—Bernhard Kreten

[57] ABSTRACT

An apparatus for enhancing the sartorial resplendency of one's garb including a belt having a plurality of slits through which an ornamental scarf is adapted to pass by threading the scarf into the slits and manipulting the scarf in various orientations to provide visual enhancements on an exposed surface of the belt which carries the scarf, thereby providing accents for one's wardrobe.

1 Claim, 11 Drawing Sheets

20

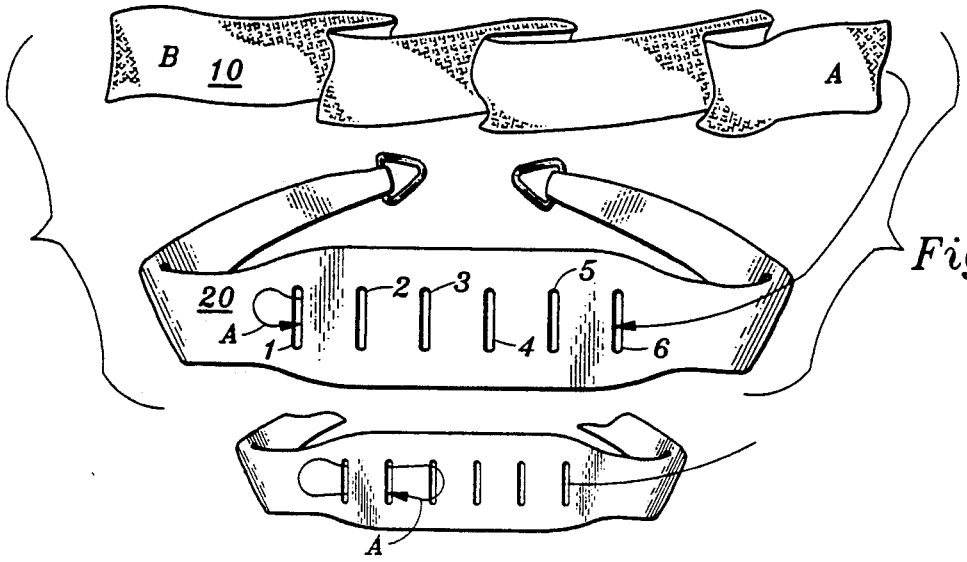
Fig. 10A
Fig. 10B
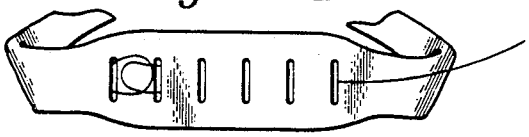
Fig. 10C
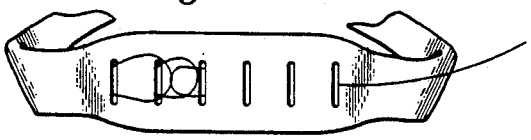
Fig. 10D
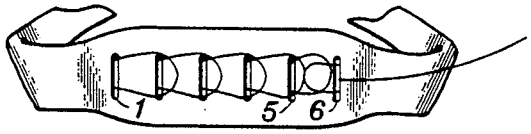
Fig. 10E
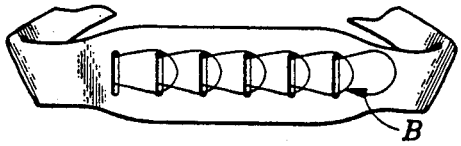
Fig. 10F
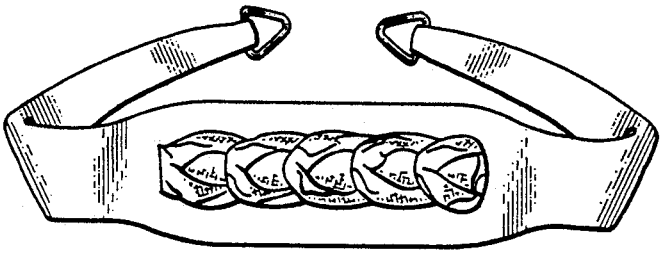
Fig. 10G

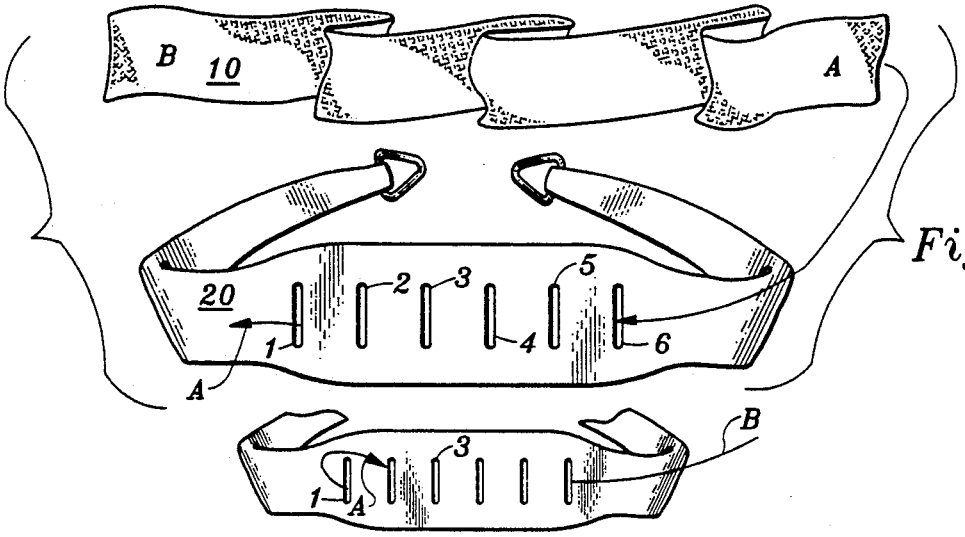
Fig. 16A
Fig. 16B
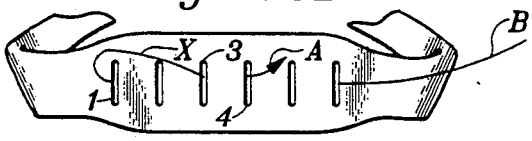
Fig. 16C
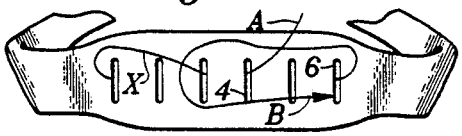
Fig. 16D
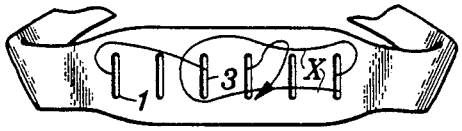
Fig. 16E
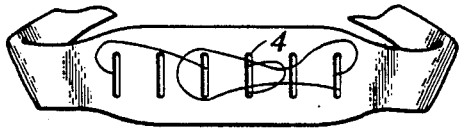
Fig. 16F
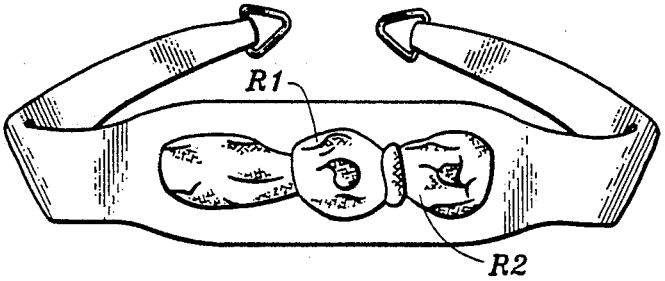
Fig. 16G

BELT WITH POUCH AND SLITS FOR RETAINING A SCARF

FIELD OF THE INVENTION

The following invention relates generally to a belt for utilization around a torso of a person. The belt has been enhanced by utilization of a scarf to embellish the aesthetic appearance of the belt and also to promulgate a wide variety of clothing accents to enhance one's wardrobe.

BACKGROUND OF THE INVENTION

Many articles of clothing devolve from resources which can be regenerated, such as leather from animals or textiles which are produced from animals or plants. However, conservation of resources and energy should dictate that these wardrobe articles be enhanced and provided with greater utility because this would be both fiscally responsible as well as environmentally sound. Although articles of apparel such as belts are not inordinately expensive, they still can provide fashion accents while being functional. Maximum benefit can be obtained in optimizing one's wardrobe heretofore only by the skillful matching of multiple complementary articles.

The following patents reflect the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | U.S. Pat. No. | ISSUE DATE |
|---|---|---|
| Frothingham, A.G. | 594,201 | November 23, 1897 |
| Orayeh, E. | Des. 32,863 | June 19, 1990 |
| Wasserstrom, W. | Des. 33,621 | November 27, 1900 |
| Sachs, M. | Des. 95,549 | May 7, 1935 |
| Alexandre, P. | 2,084,720 | June 22, 1937 |
| Bensel, D. | 2,427,119 | September 9, 1947 |
| Rand, R. | 3,848,270 | November 19, 1974 |

The patent to Orayeh teaches the use of a belt formed from a plurality of rings defining the belt through which ribbon is adapted to pass.

The patent to Wasserstrom teaches the use of a belt which cooperates with a decorative lozenge-shaped panel provided with vertical slits through which the belt is threaded.

The patent to Rand teaches the use of a belt having interchangeable decorative strips in which the strips are detachably fastened to the outside of the belt. The strips are readily removable so that they may be replaced by other strips in order to be coordinated with the garment being worn.

The patent to Bensel teaches the use of a garment belt in which an insert is operatively associated with a major body of the belt for decorative enhancement. The display member threads through slots on the belt by virtue of a leader and portions of the display show through the belt.

The remaining patents show the state of the art further.

SUMMARY OF THE INVENTION

The instant invention is distinguished over the known prior art in a plurality of ways. Initially, it should be noted that although the literature is fairly rich at attempts in enhancing the utility of a solitary belt to accommodate various fashion situations, none of the prior art contemplates the utilization of both a method and apparatus for coupling a belt to an existing, known article of manufacture defined as a scarf.

Scarves, heretofore commonly worn around the neck or head area as embellishments to one's wardrobe, can now lend themselves for deployment with the belt structure to be delineated hereinafter. Since many wardrobe owners already have a large selection of scarves that provide a welcomed accent to one's wardrobe, these scarves are to be operatively associated in combination with the belt structure of the instant invention to accent one's dress while substantially expanding the scope of one's wardrobe.

In essence, the belt is formed from a front and a rear panel. At least the front panel and optionally both panels are provided with apertures through which the scarf can be initially compressed by threading therethrough. Upon appropriate deployment of the scarf within the plurality of slits defining the apertures in the belt, the scarf can be expanded to provide a prominent display while supported by the belt.

OBJECTS OF THE INVENTION

Accordingly, it is a primary object of the present invention to provide a novel and useful fashion accessory to be worn as a belt to enhance one's wardrobe.

Another object of the present invention is to provide a device as characterized above which greatly expands one's wardrobe by the deployment of conventional scarves on a special belt, such that when deployed on the belt, the device provides fashion accents heretofore unobtainable.

A further object of the present invention is to provide a device as characterized above which facilitates the expeditious placement of any of several diverse scarves on a belt to economically expand one's wardrobe.

A further object of the present invention is to provide a device as characterized above which is relatively inexpensive to manufacture, lends itself to mass production techniques and is extremely easy to use.

A further object of the present invention is to provide a device as characterized above which promulgates a multiplicity of orientations of the scarf on the belt to achieve various different effects.

Viewed from a first vantage point, it is an object of the present invention to provide a scarf and a belt ensemble. The ensemble includes a belt formed with scarf-receiving areas, and the belt is characterized as an elongate strap having termini provided with complemental fastening means to convert the elongate strap into a closed loop by enabling the fastening means to be joined together, thereby circumscribing a torso of a person. The scarf is removably attached to the belt at the scarf receiving areas so that a multiplicity of different scarves may be operatively associated with the belt.

Viewed from a second vantage point, it is an object of the present invention to provide a method for enhancing sartorial resplendency, the steps including: forming a belt having termini, providing the belt with a plurality of slits inboard from the termini and threading a scarf in the slits such that portions of the scarf remain exposed on an outer surface of the belt.

Viewed from yet a third vantage point, it is an object of the present invention to provide a scarf and belt ensemble with the belt having scarf-receiving means located along a central portion of the belt so that portions of the belt adjacent termini of the belt neither receive nor support the scarf, and having the scarf formed from fabrics substantially thinner and more compressible than the belt with the scarf having a total surface area substantially greater than the belt whereby the scarf is initially compressed to be engaged by the scarf-receiving means and once located within the receiving means expanded on an exterior exposed surface of the belt.

These and other objects will be made manifest when considering the following detailed specification when taken in conjunction with the appended drawing figures.

DESCRIPTION OF THE DRAWINGS FIGURES

FIGS. 10A through 10G show another technique of utilization of the scarf in the FIG. 1 belt.

FIGS. 16A through 16G show another technique of utilization of the scarf in the FIG. 1 belt.

DESCRIPTION OF PREFERRED EMBODIMENTS

Figure 1A:
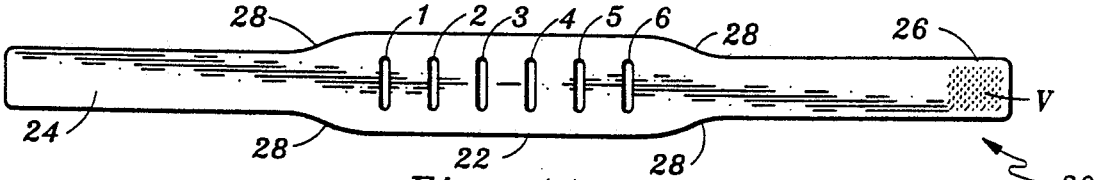
FIG. 1A is a top plan view of the belt according to one form of the invention.

Considering the drawings now, wherein like reference numerals denote like parts, reference numeral 10 is directed to the scarf of the present invention and reference numerals 20, 30, 40 and 60 are directed to different belts associated with the instant invention.

Figure 4:
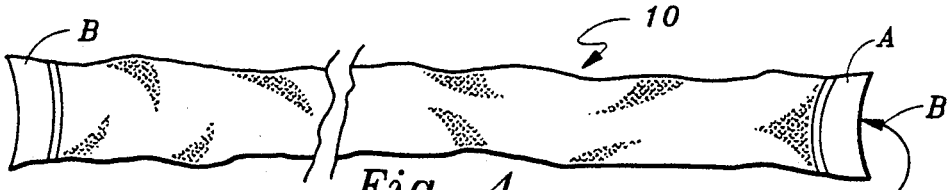
FIG. 4 is a top plan view of the scarf to be used with the FIG. 1 through 3 variants.
Figure 5A:
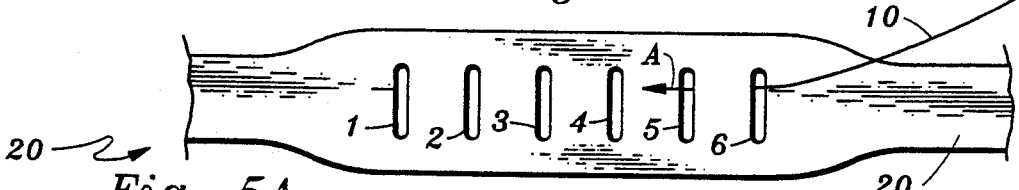
FIGS. 5A through 5G show one technique of utilization of the FIG. 4 scarf in the FIG. 1 belt.
Figure 5B:
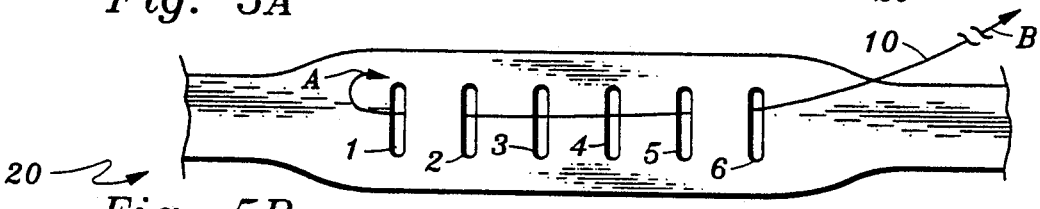
Figure 5C:
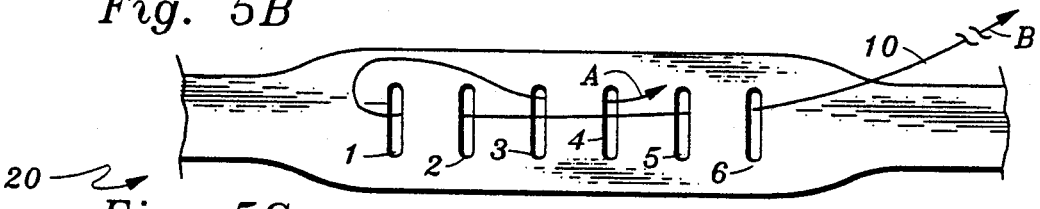
Figure 5D:
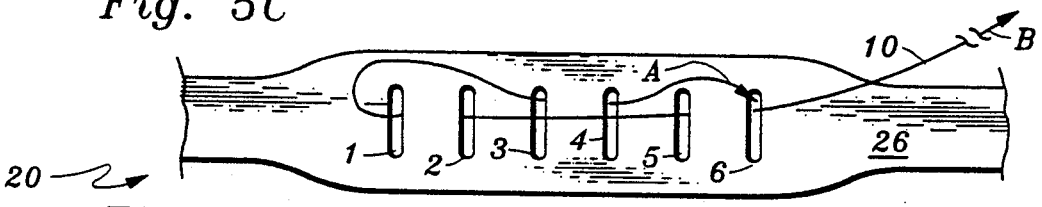
Figure 5E:
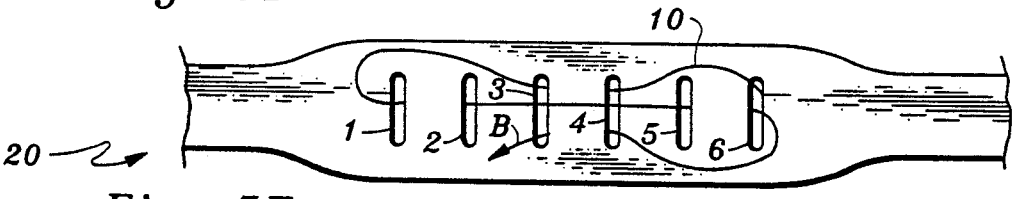
Figure 5F:
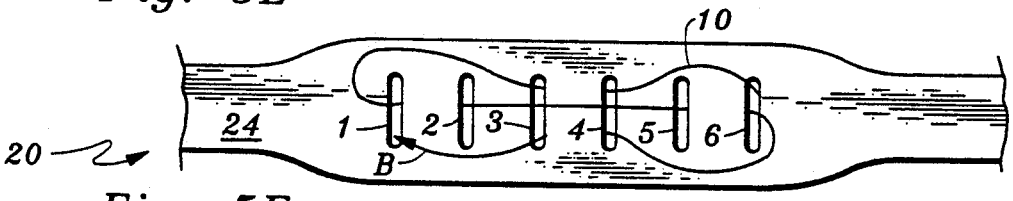
Figure 5G:
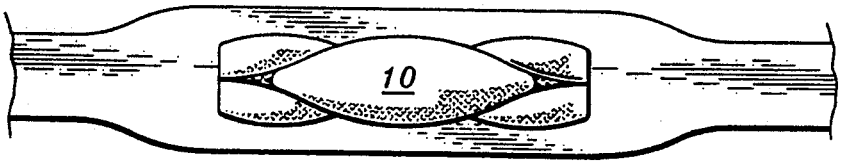

In essence, the scarf 10 of FIG. 4 is threaded through a plurality of slits or holes formed in the belt to provide a design effect such as the one shown in FIG. 5G.

To achieve that effect, the belt 20 of FIG. 1 is used which is constructed as follows. The belt 20 includes a central portion 22 and termini 24, 26. The termini 24, 26 have complemental fastening means such as hook and eyelets V which are commercially available. Some are sold under the trademark Velcro TM. Others may be interlocking triangular shaped rings R (as per FIG. 6A e.g.) In essence, the central portion has a greater width than the termini 24, 26 and includes a transition 38 extending between the central portion and the termini. Thus, as shown only approximately the central one-third of the belt has a greater width than the termini.

A plurality of slits are provided on the central portion of the belt 20 and are oriented transverse to the longitudinal axis of the belt 20. As shown, all slits have an equal length and are also substantially equal to the width of the belt 20 adjacent termini. The slits are oriented parallel to each other and transverse to the longitudinal axis of the belt 20. Six slits are provided in the exemplary embodiment and are numbered 1 to 6 from left to right. This nomenclature will also define a method as will be apparent when considering FIGS. 5A through 5G.

Figure 1B:
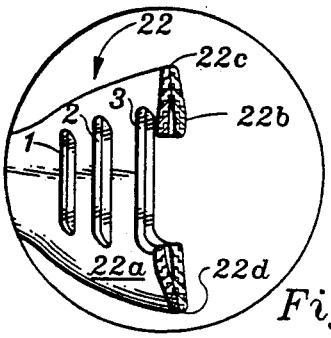
FIG. 1B is a perspective view of a portion of FIG. 1A partially in section.
Figure 1C:
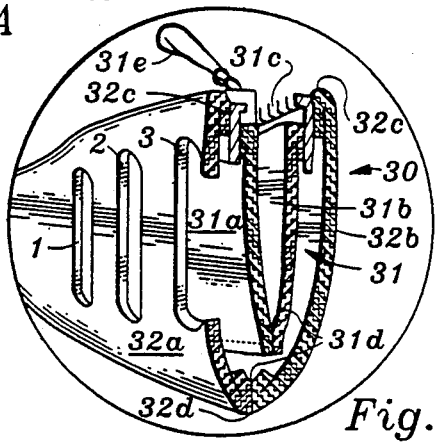
FIG. 1C is a modified view of FIG. 1B.

FIGS. 1B and 1C show different possible construction details of the belt 20. In FIG. 1B, the holes 1,2,3 etc., are intended to extend entirely through the belt 20. In this embodiment, the belt 20 is formed from a front panel **22*a* and a back panel 22*b*. The front and back panels are interconnected at top and bottom edges thereof by means of a top seam 22*c* and a bottom seam 22*d*. Thus, the holes 1,2,3, etc. extend through both the front panel 22*a* and the rear panel 22*b* so that when a scarf (to be described) is placed therein, the scarf 10**, passes entirely beyond both the front panel and the back panel.

FIG. 1C reflects a variant in which the belt is denoted by reference numeral 30. In essence, a front panel **32*a* is provided with a plurality of slits 1,2,3 etc., but the rear panel 32*b* does not also include slits passing therethrough. Thus, the scarf 10 is intended to pass through to an interior between the front panel 32*a* and the rear panel 32*b*. These front and back panels are interconnected by a bottom seam 32*d* and a top seam 32*c*. Whereas the bottom seam 32*d* parallels the FIG. 1B version, the top seam 32*c* instead supports a zipper 31*c* allowing access to the interior of the belt 30 wherein a pouch 31 is provided. The pouch 31 includes a front pouch wall 31*a* and a rear pouch wall 31*b*. Thus, after opening the pouch 31 by means of the zipper pull tab 31*e* the zipper 31*c* exposes an interior of the pouch 31 so that one may put personal articles therewithin. A bottom seam 31*d* seals the pouch 31 from the remainder of the belt 30. Note that the pouch 31 is an option which is not necessary per se for the proper operation of the scarf 10 plus the belt 30. The slits 1,2,3 etc. can be accessed by a scarf 10 without interference by the pouch 31. Therefore, it should now be evident that the solid back panel 32*b* does not interfere with weaving the scarf 10 into the belt 30**.

Figure 2A:
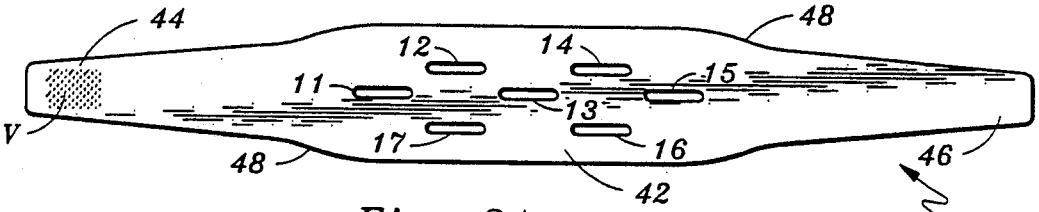
FIG. 2A is a top plan view of a second form of belt according to the present invention.
Figure 2B:
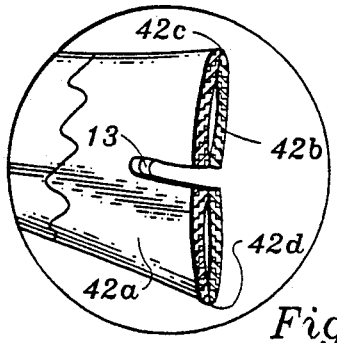
FIG. 2B is a perspective view of a portion of FIG. 2A shown in section.
Figure 2C:
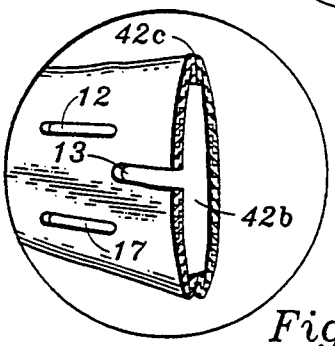
FIG. 2C is a variant from FIG. 2B.

With respect to FIGS. 2A through 2C, a second form of belt 40 is described. The salient difference between the FIG. 2 version and the FIG. 1 version is that the slits or holes are oriented such that they run parallel to the longitudinal axis of the belt in FIG. 2 whereas in FIG. 1 the slits or holes were oriented transverse to the long axis. The FIG. 2 version provides aesthetically pleasing variations of a scarf 10 upon the belt 40. FIG. 2A illustrates one possible scheme for orienting the slits in a horizontal manner. As shown, three horizontal rows of slits are provided with one slit each from both the top and bottom rows oriented in vertical registry. The slits in the middle row are offset such that those slits 11,13 and 15 are staggered from the columns of slits 12 and 17,14 and 16 in the top and bottom rows.

Thus, in this version, the first and third rows each have two slits while the second row has three slits with the middle slit of the second row being centrally located. Similar to FIG. 1, the belt 40 includes a central portion 42 and termini 44, 46 which have a lesser width than the central portion 42. In FIG. 2, however, the terminal portions of the belt outboard transition 48 taper towards the termini rather than having parallel side edges.

With respect to FIG. 2B, the sectional view along the central most hole 13 has been shown. The belt 40 includes a front panel 42*a*, and a rear panel 42*b*. A top seam 42*c* and a bottom seam 42*d* unite the two panels forming the belt 40. As shown, all of the holes (i.e., 11–17) pass through both the front and rear panels.

FIG. 2C reflects an analog of FIG. 1C wherein the slits 11 through 17 do not pass through both the front and rear panel but only through the front panel 42*a*. The rear panel 42*b* is non-foraminous and therefore has no scarf-receiving slit passing therethrough. It should also be evident that the FIG. 2C version is equally amenable to the pouch 31 by modifying the top seam 42*c* as was done in FIG. 1C.

Figure 3A:
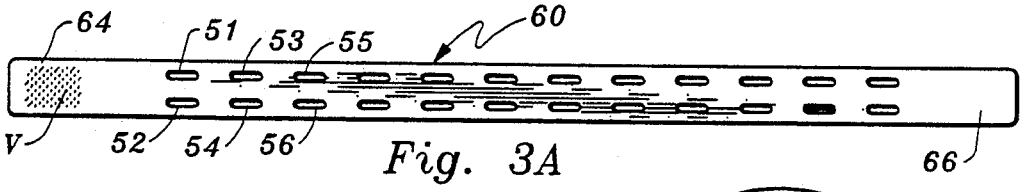
FIG. 3A is a top plan view of a third form of belt according to the present invention.
Figure 3B:
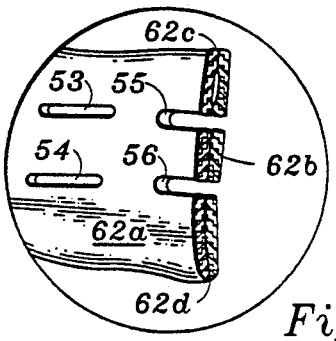
FIG. 3B is a perspective view of a portion of FIG. 3A in section.

A further version of the belt is shown in FIGS. 3A and 3B. In this embodiment, the belt 60 is configured as an elongate rectangular blank of uniform width along the entire length of the belt 60. The belt 60 has extremities 64,66 provided with fasteners as before. In addition, a multiplicity of slits 51, 52, 53, 54, 55, 56, etc. extend along the central mid-portion of the belt exclusive of the termini. These slits are disposed in vertically aligned pairs (e.g., 51 and 52,53 and 54, etc.) along the central portion of the belt 60. Note that these slits are oriented parallel to the long axis of the belt 60 and are shown horizontally. FIG. 3B reflects versions analogous to FIGS. 1B and 2B: to wit, the slits extend through both a front panel 62*a* and a rear panel 62*b*. As before, a bottom seam 62*d* and a top seam 62*c* unite the front panel 62*a* and the rear panel 62*d*. It should be apparent from the foregoing discussions however, that the back panel 62*b* could be non-foraminous as shown and taught in FIGS. 1C and 2C. Further, a pouch could be interposed between the front panel and the rear panel as shown in FIG. 1C.

FIG. 4 is an illustrative embodiment of a scarf 10 which can be commercially bought and is characterized as having a decorative exterior configuration that goes to the heart of the invention in that it enhances the belt and therefore accents one's wardrobe. The scarf 10 is characterized as preferably having a surface area (when laid flat) greater than the surface area of the scarf 10 so the belt is initially compressed for insertion into the slits and that once the scarf 10 has been deployed, as suggested in FIG. 5G, it can be expanded and enlarged to provide a more dominating effect than is heretofore known in the prior art. When appropriately manipulated, this expansion and "fluffing" will allow the scarf 10 to amplify the space between slits providing different interesting effects such as rosettes, large braids, bows, etc.

For the purposes of describing possible threading methods, FIGS. 4 and 5 are intended to be exemplary and set a platform of nomenclature and methodology in order to readily understand other variants. Thus, one end of the scarf 10 in FIG. 4 bears the legend A and at opposite end B. This similarity is carried through when referring to the arrows of FIG. 5 provided on a compressed scarf 10 but symbolized by the line 10 for clarity. In addition, the numbering sequence of the slits 1 through 6 have added significance in describing other possible threading patterns of the scarf 10 into the belt 20.

End A of scarf 10 goes in slit 6 and out slit 5. Please see FIG. 5A. End A then goes over slits 3 and 4 and into slit 2. End A comes out slit 1. Please see FIG. 5B. End A goes over slits 1 and 2 and into slit 3 and out slit 4. Please see FIG. 5C. Lastly, end A goes over slit 5 and into slit 6 and is tucked within the space afforded between slit 6 and end 26. With end A tucked into the space provided between the front panel 22*a* and the rear panel 22*b* of the belt via slot 6, only one free end B remains. End B is passed over slit 5 and into slit 4, coming out of slit 3 as shown in FIG. 5E. Finally, end B passes over slit 2 and into slit 1 where it is retained by tucking end B into slit 1 and towards end 24 as shown in FIG. 5F.

While the line representations of FIGS. 5A through 5F simplify the visual understanding of the invention, they also connote one of the attributes of the instant invention when used in a preferred manner. The scarf 10 is normally formed from relatively sheer material which allows it to be easily compressed and threaded into the slits. Where a heavier gauge of scarf 10 material is desired, the scarf 10 can be rolled into a cylinder to achieve similar benefits. The FIG. 5G version shows one possible expansion of the scarf 10 once it has been oriented as shown in FIG. 5A through F.

Note that the finished version of FIG. 5G does not provide an impediment to access the pouch 31 of FIG. 1C version.

Figure 6A:
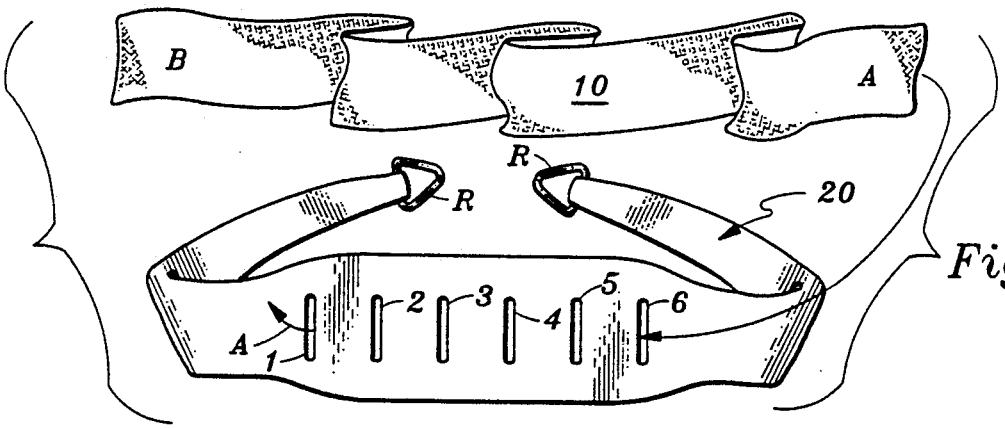
FIGS. 6A through 6C show another technique of utilization of the scarf in the FIG. 1 belt.
Figure 6B:
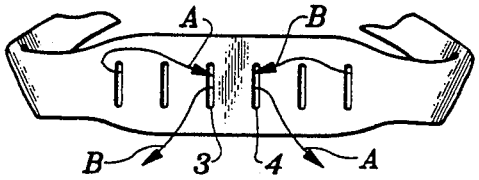
Figure 6C:
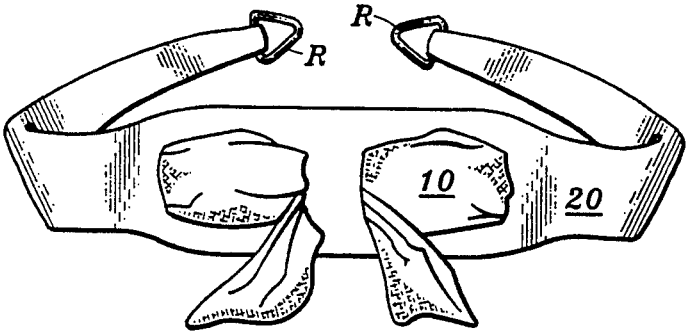

FIGS. 6A through 6C reflect the following methodology of another way to orient the scarf 10. Tuck end A of scarf in hole (or slit) 6 and pull through hole 1. Even out the lengths. Bring both ends, A and B, to center. End A passes into slit 3 and out slit 4. End B passes into slit 4 and out slit 3. Fluff the scarf 10.

Figure 7A:
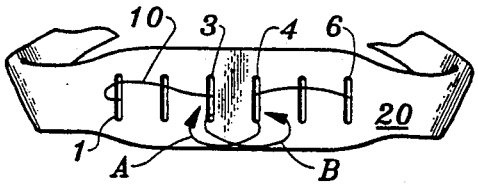
FIGS. 7A and 7B show another technique of utilization of the FIG. 4 scarf in the FIG. 1 belt.
Figure 7B:
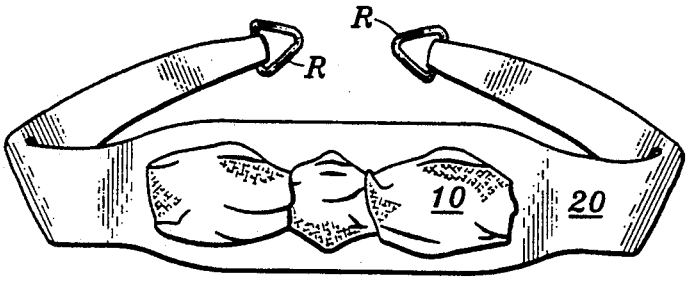

FIGS. 7A and 7B utilize the FIGS. 6A through 6C steps and further include looping ends A and B back through opposite center holes (i.e., the end A coming out of hole 4 loops to hole 3 and end B exiting hole 3 loops into hole 4). Fluff scarf 10 as per FIG. 7B.

Figure 8A:
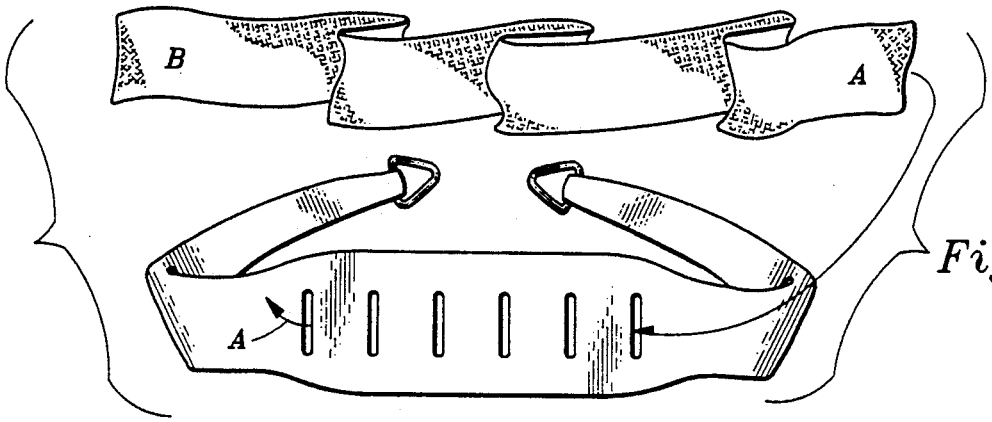
FIGS. 8A through 8C show another technique of utilization of the scarf in the FIG. 1 belt.
Figure 8B:
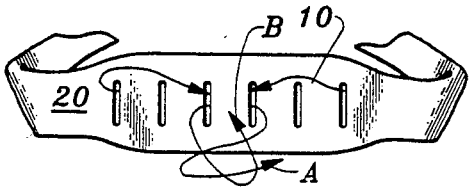
Figure 8C:
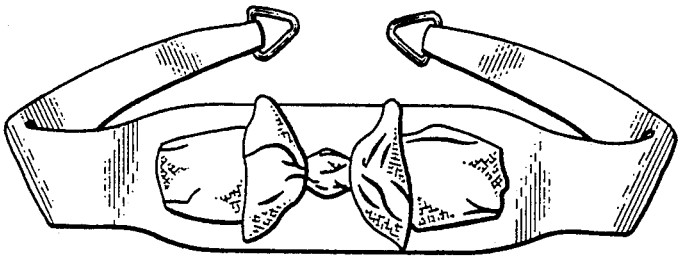

FIGS. 8A through 8C rely on the foundational steps of FIGS. 6A through 6C. Next tie ends A and B into a square knot (FIG. 8B) and flare the free ends into a bow, as shown in FIG. 8C.

Figure 9A:
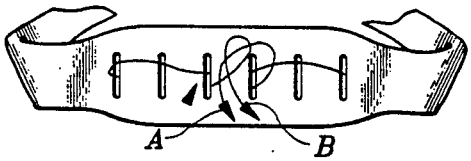
FIGS. 9A and 9B show another technique of utilization of the FIG. 4 scarf in the FIG. 1 belt.
Figure 9B:
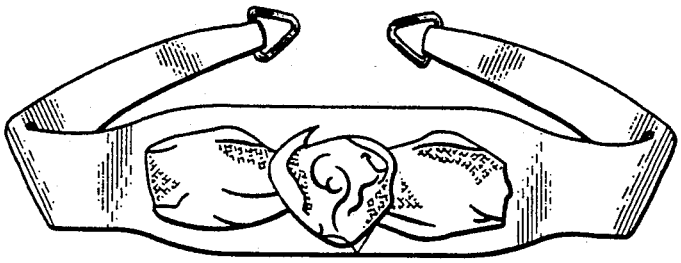

FIGS. 9A and 9B rely on the foundational steps of FIGS. 6A through 6C. Next bring ends A and B together, knot together as one slip style knot, and fan ends into a rosette as per FIG. 9B.

FIGS. 10A through 10G show another design. Tuck one end A of scarf 10 in hole 6 and pull through hole 1. Create a first loop at hole 1 (FIG. 10A). Pull scarf 10 out hole 2, creating a second loop (FIG. 10B). Weave these two loops together (FIGS. 10C and 10D). Continue process through to hole 5 (FIG. 10E). Weave scarf 10 end B (now coming out hole 6) into the loop formed at hole 5 (FIG. 10F). Tuck end B back into hole 6. Fluff as per FIG. 10G.

Figure 11A:
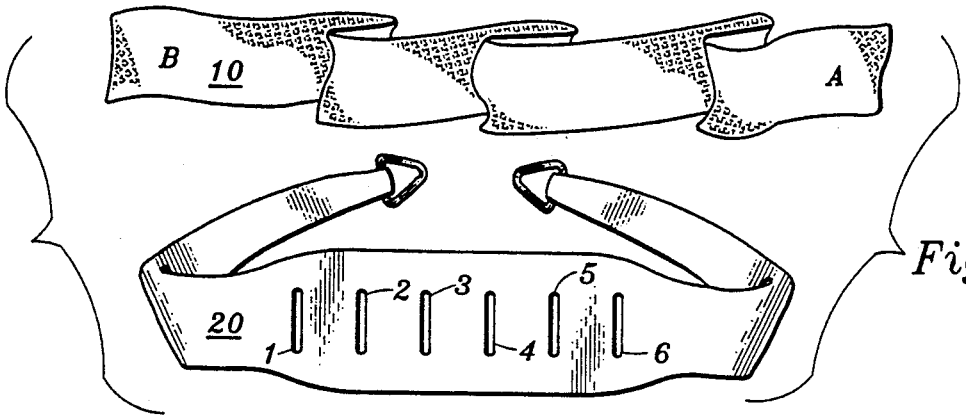
FIGS. 11A through 11H show another technique of utilization of the scarf in the FIG. 1 belt.
Figure 11B:
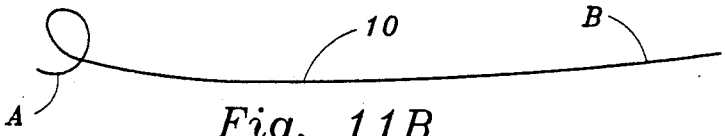
Figure 11C:
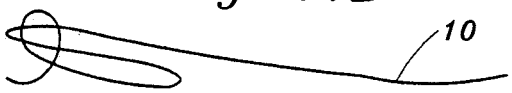
Figure 11D:
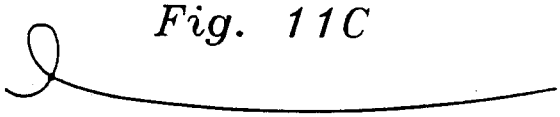
Figure 11E:
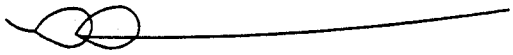
Figure 11F:
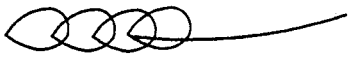
Figure 11G:
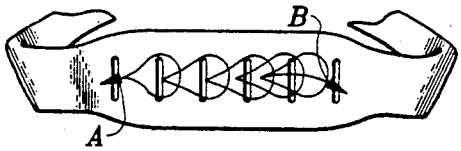
Figure 11H:
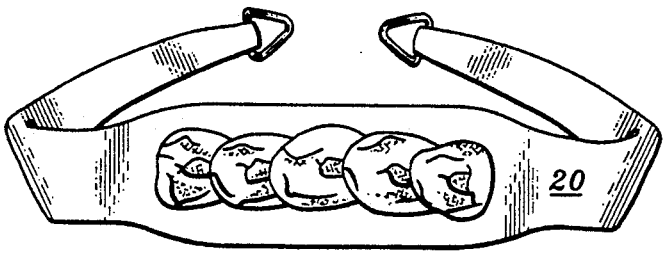

FIGS. 11A through 11H show another design. Assemble scarf 10 for this design before placing the scarf 10 into the belt. Tie a slip knot into end A of the scarf 10 creating a loop and leaving a free end. (FIGS. 11B through 11D.) Through this loop create a repetitive chain (FIGS. 11E through 11F). Upon completion, tuck ends A into hole 1 and end B into hole 6 (FIG. 11G). Fluff to achieve FIG. 11H.

Figure 12A:
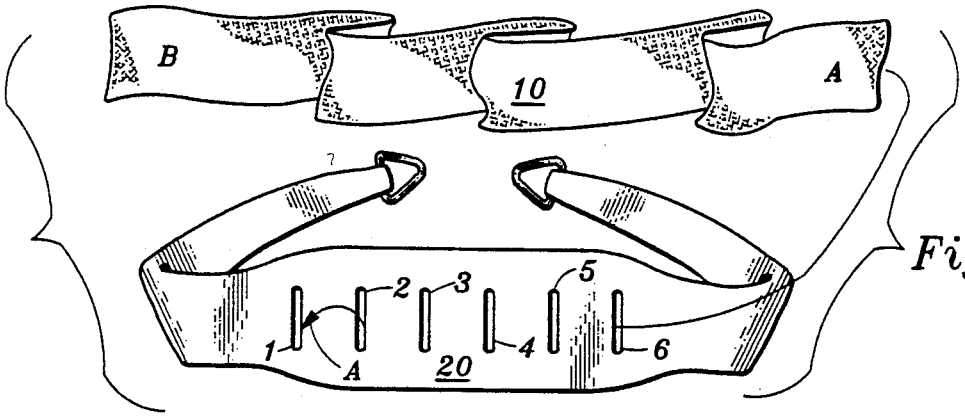
FIGS. 12A through 12G show another technique of utilization of the scarf in the FIG. 1 belt.
Figure 12B:
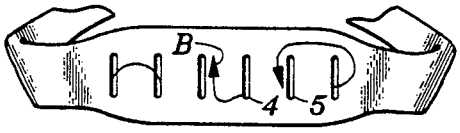
Figure 12C:
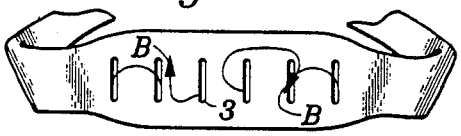
Figure 12D:
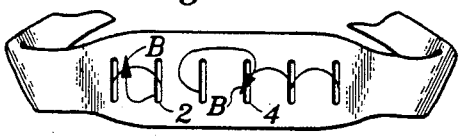
Figure 12E:
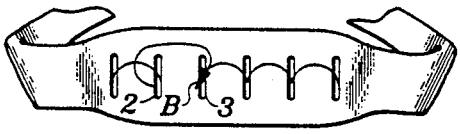
Figure 12F:
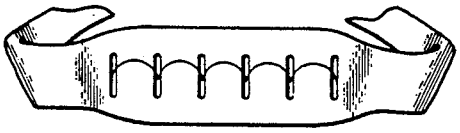
Figure 12G:
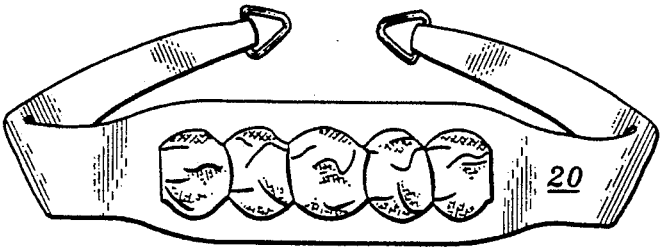

FIGS. 12A through 12G show another design. Tuck end A of the scarf 10 in hole 6 and pull through hole 2. Form a loop and tuck end A into hole 1, (FIG. 12A). With end B, loop into 5, pull out hole 4, (FIG. 12B). Loop end B from 4 back into 5, and pull out 3, (FIG. 12C). Loop end B from 3 into 4, pull out 2, (FIG. 12D). Loop end B from 2 and tuck into 3, (FIG. 12E). FIG. 12F when fluffed, emulates FIG. 12G.

Figure 13A:
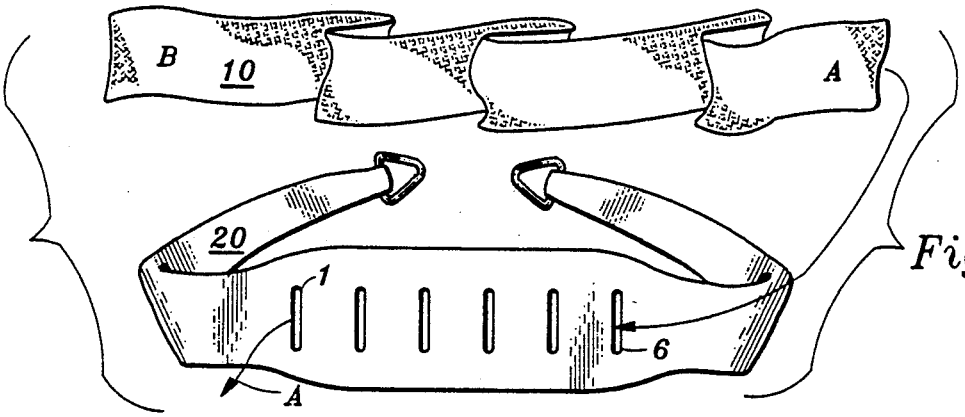
FIGS. 13A through 13C show another technique of utilization of the scarf in the FIG. 1 belt.
Figure 13B:
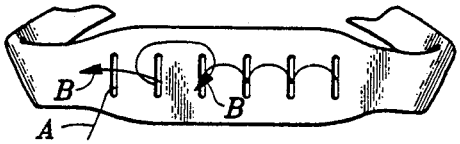
Figure 13C:
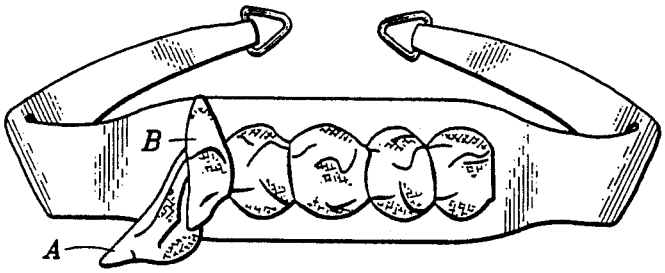

FIG. 13 is another embodiment in which the basic steps of FIG. 12 are repeated, except bring first end A of the scarf 10 to hole 1 and hang end A out. Complete the other steps for end B as described for FIG. 12. Finish by bringing final end B back out hole 2 (i.e., FIG. 12E) and flare ends.

Figure 14A:
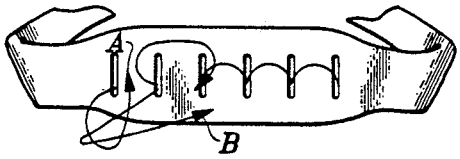
FIGS. 14A and 14B show another technique of utilization of the FIG. 4 scarf in the FIG. 1 belt.
Figure 14B:
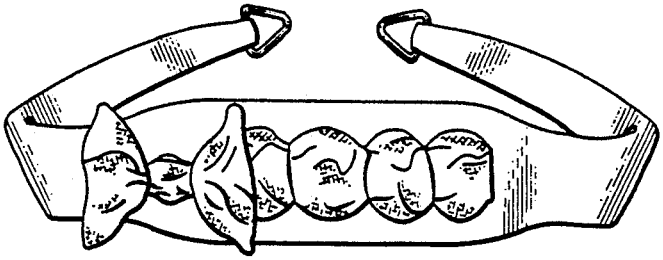
Figure 15A:
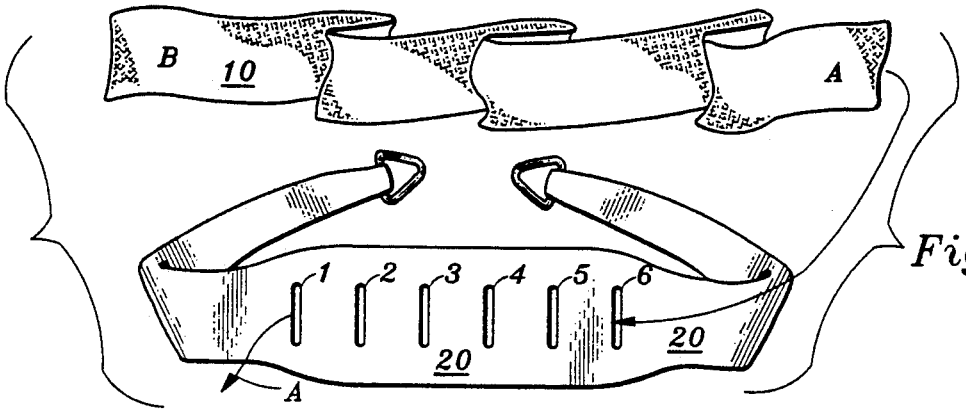
FIGS. 15A through 15D show another technique of utilization of the scarf in the FIG. 1 belt.
Figure 15B:
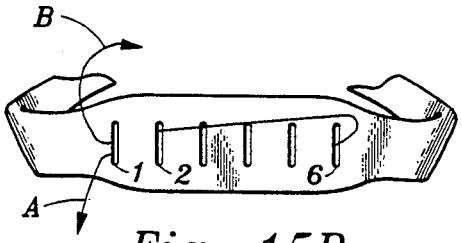
Figure 15C:
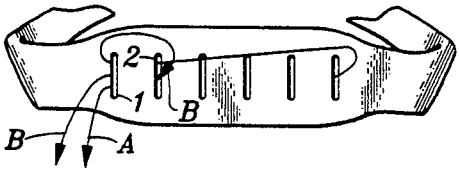
Figure 15D:
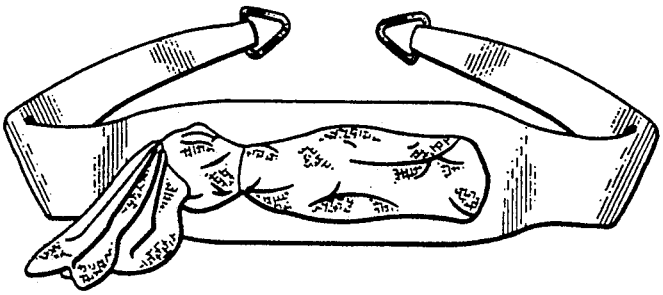

FIGS. 14A through 14B replicate FIG. 13 but after the step of FIG. 13B tie ends A and B into square knot, and flare into bow.

FIGS. 15A through 15D reflect another embodiment in which end A of the scarf 10 is tucked in hole 6 and pulled through hole 1. Bring end B across the top of belt 20 and tuck end B into hole 2 and out hole 1. Loop end B around and back into hole 2 and out hole 1.

FIG. 16A through 16G show another embodiment in which end A of the scarf 10 is tucked in hole 6 and pulled through hole 1, (FIG. 16B). Loop end A back over hole 2 and into hole 3 and out hole 4, (FIGS. 16B and 16C). Bring end B over top, weave through the loop X formed by end A between hole 1 and hole 3, tucking end B into hole 6, (FIG. 16D). With end A hanging out hole 4, loop over top of "big" loop (Y formed by end B having been looped through loop X) and back into hole 4, creating 2 rings R1 and R2, (FIGS. 16E and 16G).

Figure 17A:
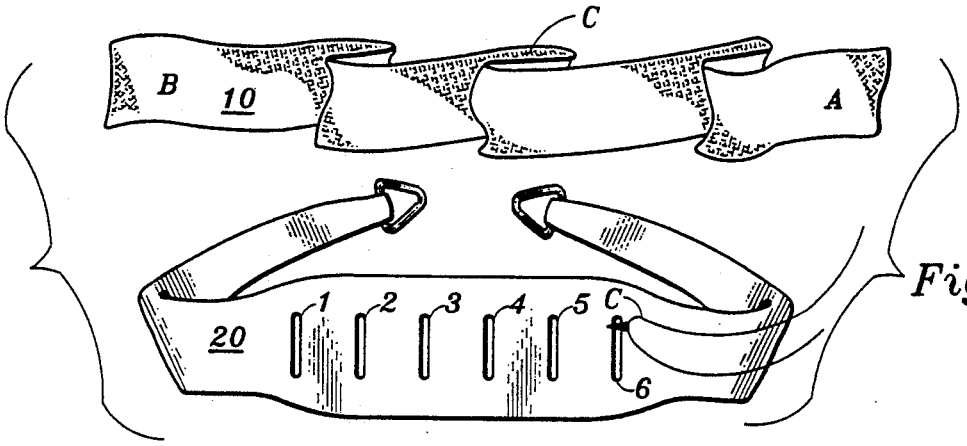
FIGS. 17A through 17D show another technique of utilization of the scarf in the FIG. 1 belt.
Figure 17B:
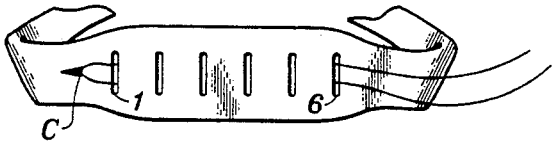
Figure 17C:
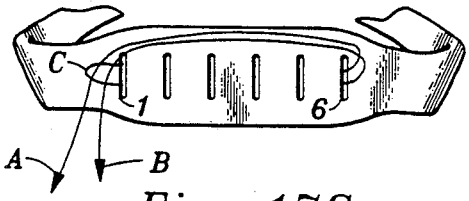
Figure 17D:
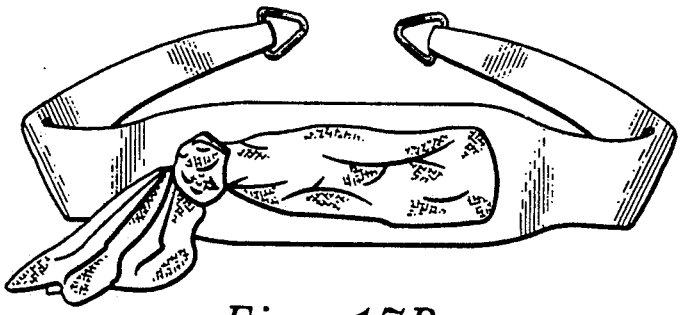

FIGS. 17A through 17D show another embodiment in which the scarf 10 is folded in half. Tuck middle portion C of the folded scarf in hole 6 and pull the scarf through hole 1, (FIG. 17B). Fold both free ends A, B across the belt 20 and place the free ends A, B through the loop at hole 1. Pull tight and flare, (FIGS. 17C and 17D).

As should now be evident, the other belts shown in FIGS. 2A and 3A are capable of similar scarf manipulations.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. An ensemble formed from a scarf and a belt, comprising in combination:

said belt having a top and bottom seam at upper and lower extremities thereof and including scarf receiving means, said belt configured as an elongate strap having termini including complemental fastening means to convert said elongate strap to a closed loop by enabling said fastening means, thereby circumscribing a torso of a person, said scarf removably attached to said belt at said scarf receiving means so that one of a multiplicity of different scarves are operatively associated with said belt.

said scarf receiving means located along a central portion of said belt so that portions of said belt adjacent said termini connect said termini and said complemental fastening means to said central portion while neither receiving nor supporting said scarf, said portions of said belt adjacent said termini extending from said central portion to said termini and being non-foraminous, said scarf formed from fabric substantially thinner in a thinnest dimension than a thinnest dimension of said belt and said scarf formed from fabric more compressible than said belt, and said scarf having a total surface area greater than said belt, whereby said scarf is initially compressed to be engaged by said scarf receiving means and thereafter expanded, and pouch means formed on said belt to receive articles therewithin, said pouch means formed from a pair of pouch walls within said belt and having a closed bottom and an open top, said open top closeable with a zipper at said top seam of said belt.

* * * * *